US010579007B2

(12) United States Patent
Sato

(10) Patent No.: US 10,579,007 B2
(45) Date of Patent: Mar. 3, 2020

(54) IMAGE FORMING APPARATUS FOR EXECUTING COLOR REGISTRATION ADJUSTMENT

(71) Applicant: CANON KABUSHIKI KAISHA, Tokyo (JP)

(72) Inventor: Hiroki Sato, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/416,349

(22) Filed: May 20, 2019

(65) Prior Publication Data

US 2019/0271935 A1 Sep. 5, 2019

Related U.S. Application Data

(63) Continuation of application No. PCT/JP2017/042315, filed on Nov. 27, 2017.

(30) Foreign Application Priority Data

Nov. 29, 2016 (JP) ..... 2016-231851

(51) Int. Cl.
*G03G 15/00* (2006.01)
*G03G 15/01* (2006.01)

(52) U.S. Cl.
CPC ..... *G03G 15/6561* (2013.01); *G03G 15/0131* (2013.01); *G03G 2215/0158* (2013.01)

(58) Field of Classification Search
CPC ..... G03G 15/6561; G03G 15/0131; G03G 2215/0158
See application file for complete search history.

(56) References Cited

U.S. PATENT DOCUMENTS 5,512,986 A * 4/1996 Toyomura ..... G03G 15/1605 358/448
5,697,012 A * 12/1997 Sasanuma ..... G03G 15/01 347/115
6,148,158 A * 11/2000 Amemiya ..... G03G 15/01 358/519

(Continued)

FOREIGN PATENT DOCUMENTS

EP 2 827 573 A2 1/2015
JP 2002-023444 A 1/2002

(Continued)

*Primary Examiner* — David J Bolduc
(74) *Attorney, Agent, or Firm* — Venable LLP

(57) ABSTRACT

An image forming apparatus includes a controller configured to execute: a task that measures a plurality of first color patterns; a task that, on the basis of a first output value corresponding to a measurement result of the first color patterns, determines a threshold value; a measurement task that measures a plurality of second color patterns; and a task that detects an amount of color misregistration on the basis of a result of a comparator comparing a second output value corresponding to a measurement result of the second color patterns with a threshold value corresponding to each of the second color patterns. In the measurement task, the controller controls whether or not to set the threshold value to the threshold value corresponding to each of the second color patterns on the basis of the first output value.

13 Claims, 11 Drawing Sheets

(56) References Cited

U.S. PATENT DOCUMENTS 6,243,542 B1* 6/2001 Fujimoto ..... G03G 15/5062 399/49
8,840,221 B2 9/2014 Horikawa et al.
10,031,459 B2 7/2018 Ino et al.
2003/0128381 A1* 7/2003 Zaima ..... H04N 1/40025 358/1.9
2004/0131371 A1* 7/2004 Itagaki ..... G03G 15/5041 399/49
2005/0190386 A1* 9/2005 Zaima ..... H04N 1/4078 358/1.9
2006/0007330 A1* 1/2006 Eom ..... G03G 15/5058 348/243
2007/0237531 A1* 10/2007 Maebashi ..... G03G 15/0126 399/49
2008/0131152 A1* 6/2008 Komiya ..... G03G 15/5062 399/49
2008/0292370 A1* 11/2008 Murayama ..... G03G 15/0131 399/301
2010/0021188 A1* 1/2010 Mizumukai ..... G03G 15/161 399/31
2010/0238465 A1* 9/2010 Kageyama ..... G03G 15/0131 358/1.9
2010/0290799 A1* 11/2010 Komiya ..... G03G 15/5033 399/49
2010/0315685 A1* 12/2010 Zaima ..... G06K 15/027 358/3.26
2011/0026044 A1* 2/2011 Murayama ..... G03G 15/0131 358/1.5
2011/0097096 A1* 4/2011 Sueoka ..... G03G 15/1605 399/49
2011/0109920 A1* 5/2011 Nakase ..... G03G 15/5041 358/1.5
2011/0299861 A1* 12/2011 Ogawa ..... G03G 15/5058 399/15
2011/0304887 A1* 12/2011 Nakase ..... G03G 15/5033 358/3.24
2012/0019845 A1* 1/2012 Zaima ..... H04N 1/6033 358/1.9
2012/0020680 A1* 1/2012 Zaima ..... H04N 1/6033 399/15
2012/0033276 A1* 2/2012 Zaima ..... H04N 1/6033 358/518
2012/0207494 A1* 8/2012 Tomura ..... G03G 15/0189 399/40
2012/0218340 A1 8/2012 Horikawa et al.
2012/0288289 A1* 11/2012 Kinoshita ..... G03G 15/0189 399/39
2012/0294643 A1* 11/2012 Itagaki ..... G03G 15/0131 399/49
2012/0301163 A1* 11/2012 Hirata ..... G03G 15/0189 399/49
2012/0314227 A1* 12/2012 Zaima ..... G06K 15/027 358/1.2
2013/0016365 A1* 1/2013 Zaima ..... G03G 15/0173 358/1.2
2013/0200126 A1* 8/2013 Kokomoto ..... B65G 43/00 226/1
2013/0287457 A1* 10/2013 Sato ..... G03G 15/50 399/301
2013/0322904 A1* 12/2013 Murayama ..... G03G 15/16 399/66
2014/0255051 A1* 9/2014 Itagaki ..... G03G 15/5062 399/49
2015/0098095 A1* 4/2015 Zaima ..... H04N 1/6005 358/1.2
2015/0362868 A1* 12/2015 Sone ..... G03G 15/1615 399/49
2016/0041488 A1* 2/2016 Matsuoka ..... G03G 15/5062 399/15
2016/0085194 A1* 3/2016 Shirafuji ..... G03G 15/5025 399/49
2016/0216636 A1* 7/2016 Itagaki ..... G03G 15/04027
2016/0286091 A1* 9/2016 Negishi ..... G03G 15/01
2017/0090375 A1* 3/2017 Tanaka ..... G03G 15/5062
2017/0205750 A1* 7/2017 Takahashi ..... G03G 15/0131
2017/0235266 A1 8/2017 Ino et al.
2017/0242382 A1* 8/2017 Zaima ..... G03G 15/5037

FOREIGN PATENT DOCUMENTS

JP 2012-187914 A 10/2012
JP 2013-025184 A 2/2013
JP 2017-146390 A 8/2017

* cited by examiner

IMAGE FORMING APPARATUS FOR EXECUTING COLOR REGISTRATION ADJUSTMENT

CROSS-REFERENCE TO RELATED APPLICATIONS

This application is a Continuation of International Patent Application No. PCT/JP2017/042315, filed Nov. 27, 2017, which claims the benefit of Japanese Patent Application No. 2016-231851, filed Nov. 29, 2016, both of which are hereby incorporated by reference herein in their entirety.

BACKGROUND OF THE INVENTION

Field of the Invention

The present invention relates to color registration adjustment in an image formation apparatus.

Background Art

Tandem-type image forming apparatuses, which form color images by superimposing images of respective colors, have an advantage in that images can be formed quickly. However, color misregistration will occur if the timings at which the paper is fed, the images are formed, and so on are not controlled accurately. For this reason, image forming apparatuses carry out color registration adjustment. In color registration adjustment, an image forming apparatus forms a plurality of color patterns onto, for example, an intermediate transfer belt, and then uses a sensor to detect the relative positions of the color patterns of each color. The image forming apparatus then controls the image forming conditions so as to reduce misregistration between the relative positions of the images of the respective colors (an amount of the color misregistration).

The sensor emits light toward the intermediate transfer belt on which the plurality of color patterns are formed, and outputs a detection signal corresponding to the intensity of the reflected light. The image forming apparatus compares the detection signal from the sensor with a threshold, and determines the relative positions of the color patterns of the respective colors. Here, if the density of the color pattern is uniform, the waveform of the detection signal of each color pattern will be symmetrical relative to a center position of the color pattern. If the waveform of the detection signal is symmetrical, the image forming apparatus can detect the relative positions of the plurality of color patterns with a high level of accuracy, regardless of the threshold. However, if the density of the color pattern is not uniform, the waveform of the detection signal will be asymmetrical relative to the center position of the color pattern. There has thus been a risk that, depending on the threshold, the image forming apparatus cannot accurately detect the relative positions of the plurality of color patterns. The image forming apparatus according to Patent Document 1 ensures that the output times of signals, obtained by converting detection signals of color patterns of respective colors on the basis of a threshold, are the same time, by adjusting the threshold. According to Patent Document 1, detection error can be reduced even when the waveform of the detection signal is asymmetrical relative to the center position of the color pattern.

The image forming apparatus disclosed in Patent Document 1 must control the threshold for each color pattern passing a detection area of the sensor. However, it is possible that the change in the threshold will not occur in time between when a color pattern of a first color has passed the detection area and when the color pattern of a second color reaches the detection area. For example, if a color pattern enters the sensor detection area before the threshold stabilizes at a target threshold, error will arise in the output time of the signal obtained by converting the detection signal of the color pattern on the basis of the threshold. In other words, the threshold at the timing when the front end of the color pattern in a conveyance direction passes the detection area is different from the threshold at the timing when the back end of the color pattern in the conveyance direction passes the detection area. Error arises in the output time of the detection signal as a result. This in turn produces error in the detection of the relative positions of the plurality of color patterns.

CITATION LIST

Patent Literature

PTL 1: Japanese Patent Laid-Open No. 2013-25184

SUMMARY OF THE INVENTION

According to one aspect of the present invention, an image forming apparatus includes: a plurality of image forming units that form images, each having a different color, an intermediate transfer member that rotates in a predetermined direction, a sensor that measures reflected light from a color pattern formed on the intermediate transfer member, a comparator that compares an output value from the sensor with a threshold value, and a controller. The controller executes: a first image formation task that forms a plurality of first color patterns having different colors by controlling the plurality of image forming units; a first measurement task that measures the plurality of first color patterns by controlling the sensor; a determination task that, on the basis of a first output value corresponding to a measurement result of the plurality of first color patterns output from the sensor, determines a threshold value corresponding to each of a plurality of second color patterns having different colors; a second image formation task that forms the plurality of second color patterns by controlling the plurality of image forming units; a second measurement task that measures the plurality of second color patterns by controlling the sensor; a detection task that detects an amount of the color misregistration related to a relative position between a color pattern, among the plurality of second color patterns, that has a reference color and a color pattern, among the plurality of second color patterns, that has another color different from the reference color, on the basis of a result of the comparator comparing a second output value corresponding to a measurement result of the second color patterns output from the sensor with a threshold value corresponding to each of the second color patterns; and a correction task that corrects color misregistration between an image of the reference color and an image of the other color on the basis of the amount of the color misregistration. In the second measurement task, the controller controls whether or not to set the threshold value to the threshold value corresponding to each of the plurality of second color patterns on the basis of the first output value output from the sensor in the first measurement task.

Further features of the present invention will become apparent from the following description of exemplary embodiments with reference to the attached drawings.

BRIEF DESCRIPTION OF THE DRAWINGS

The appended drawings, which are included in and constitute part of the specification, illustrate embodiments of the present invention, and along with those descriptions serve to illustrate the principles of the present invention.

DESCRIPTION OF THE EMBODIMENTS

Hereinafter, exemplary embodiments of the present invention will be described with reference to the drawings. Note that the following embodiments are to be taken as examples only, and the present invention is not intended to be limited by the embodiments. Note also that constituent elements not necessary for the descriptions of the embodiments have been omitted from the drawings.

First Embodiment

Figure 1:
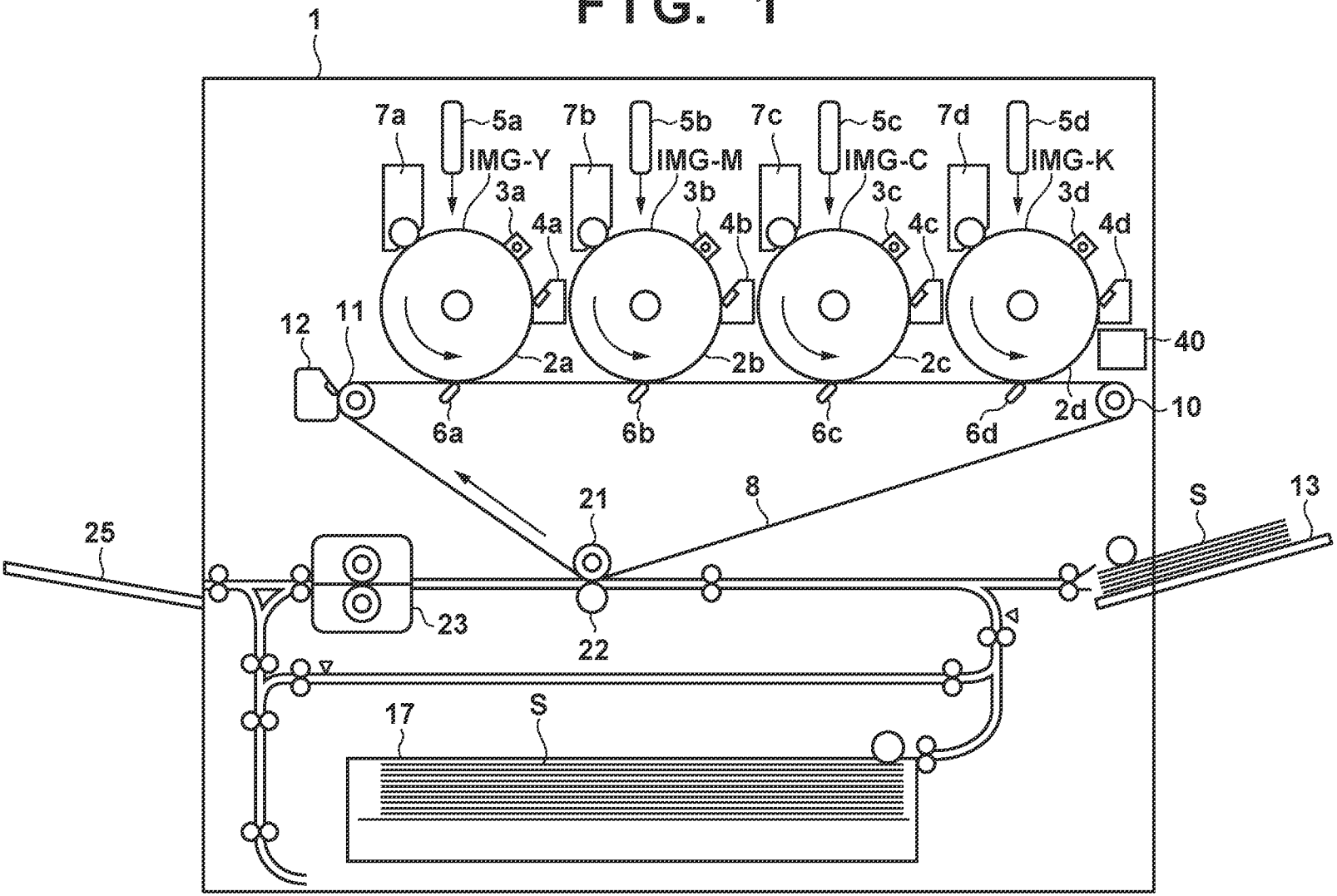
FIG. 1 is a schematic diagram illustrating an image forming apparatus according to an embodiment.

FIG. 1 is a schematic diagram illustrating an image forming apparatus 1 according to the present embodiment. The image forming apparatus 1 includes image forming units IMG-Y, IMG-M, IMG-C, and IMG-K, which form yellow, magenta, cyan, and black toner images and transfer those toner images onto an intermediate transfer belt 8. Aside from the colors of toners used, the image forming units IMG-Y, IMG-M, IMG-C, and IMG-K have the same configuration, and thus the image forming unit IMG-Y will be described hereinafter as a representative example. A photosensitive member 2*a*, which is an image carrier, is rotationally driven in the direction of the arrow when an image is to be formed. A charging unit 3*a* charges the surface of the photosensitive member 2*a* to a uniform potential. A scanning unit 5*a* forms an electrostatic latent image on the surface of the photosensitive member 2*a* by exposing the photosensitive member 2*a*. A developing unit 7*a* forms a toner image on the photosensitive member 2*a* by developing the electrostatic latent image with toner. A primary transfer unit 6*a* outputs a primary transfer bias, which transfers the toner image from the photosensitive member 2*a* to the intermediate transfer belt 8. A cleaning unit 4*a* removes toner that was not transferred onto the intermediate transfer belt 8 and remains on the photosensitive member 2*a*.

The intermediate transfer belt 8 is stretched upon rollers 10, 11, and 21, and is rotationally driven in the direction indicated by the arrow in the drawing when an image is formed. As the intermediate transfer belt 8 rotates, the toner image transferred onto the intermediate transfer belt 8 is conveyed to a position opposite a secondary transfer unit 22. Meanwhile, a sheet S placed in a cassette 17 or a tray 13 is conveyed to a position opposite the secondary transfer unit 22 to coincide with the timing at which the toner image transferred onto the intermediate transfer belt 8 arrives at the position opposite the secondary transfer unit 22. The secondary transfer unit 22 transfers the toner image on the intermediate transfer belt 8 to the sheet S by outputting a secondary transfer bias. Toner that has not been transferred onto the sheet S, and which remains on the intermediate transfer belt 8, is removed by a cleaning unit 12. The sheet S onto which the toner image has been transferred is conveyed to a fixing unit 23. The fixing unit 23 fixes the toner image to the sheet S by heating and compressing the sheet S. The sheet S onto which the toner image has been fixed is discharged to a tray 25. The image forming apparatus 1 also includes a sensor 40 for detecting an amount of the color misregistration. The sensor 40 is provided between the photosensitive member 2*d* and the roller 10, opposite the intermediate transfer belt 8.

Figure 2:
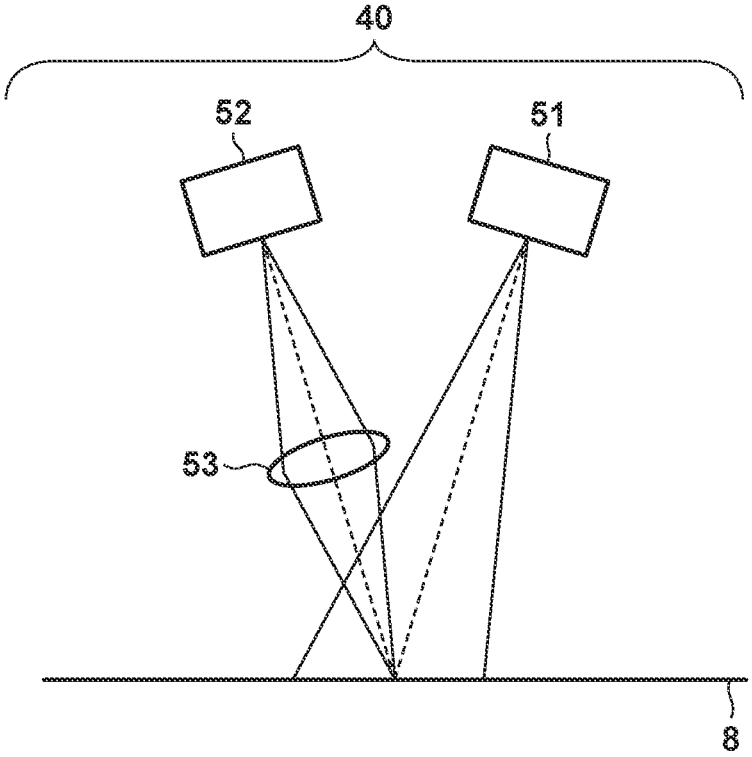
FIG. 2 is a schematic diagram illustrating a sensor according to an embodiment.
Figure 3A:
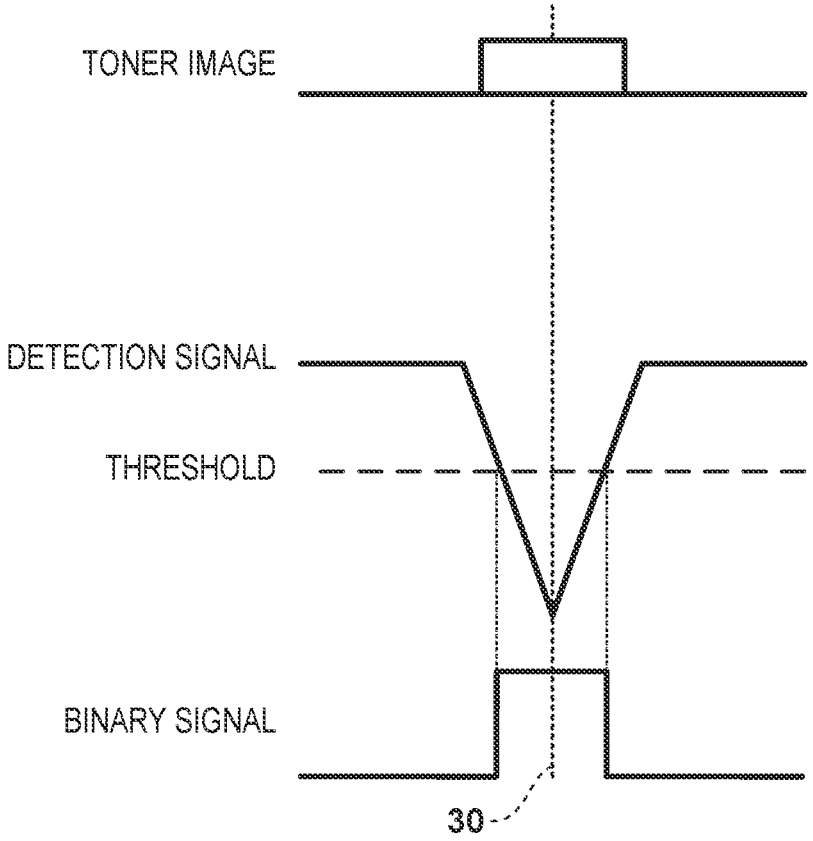
FIG. 3A is a descriptive diagram illustrating toner image position detection by the sensor.
Figure 3B:
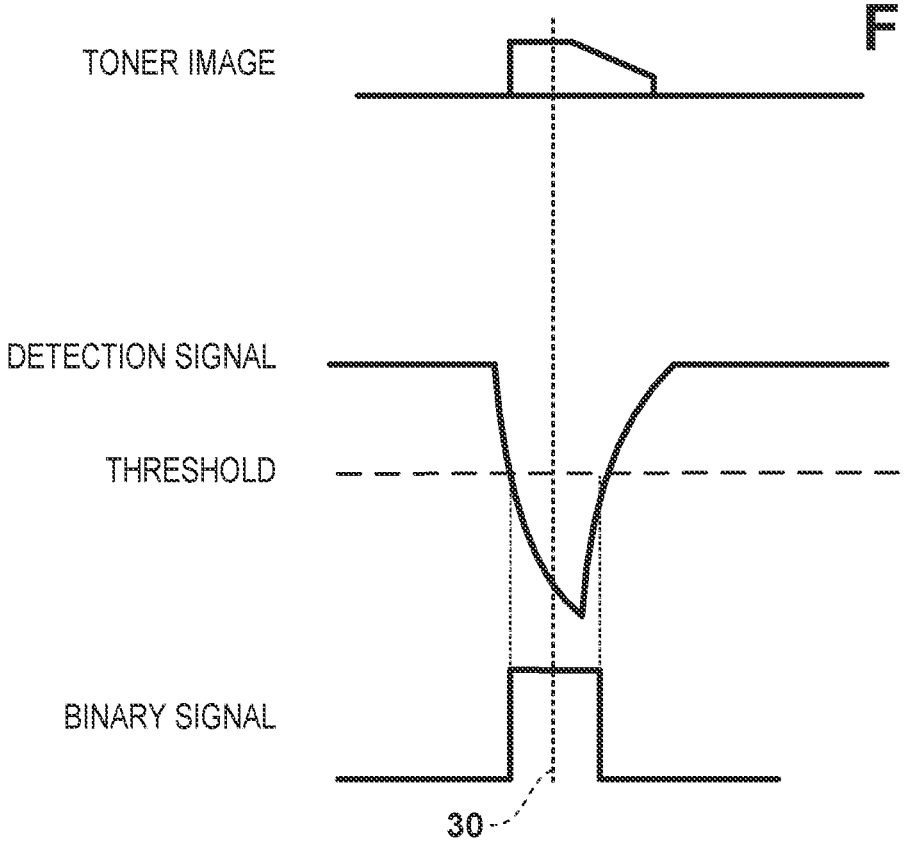
FIG. 3B is a descriptive diagram illustrating toner image position detection by the sensor.

FIG. 2 is a schematic diagram illustrating the sensor 40. The sensor 40 includes a light-emitting unit 51 and a light-receiving unit 52. The sensor 40 may be configured to further include a lens 53. The light-emitting unit 51 emits light toward the intermediate transfer belt 8. The light-receiving unit 52 receives light reflected by the intermediate transfer belt 8 (regularly-reflected light) via the lens 53. The sensor 40 outputs a detection signal on the basis of the intensity of the light received by the light-receiving unit 52 (reflection intensity). For example, the value of the detection signal (output value) increases as the reflection intensity increases, and the value of the detection signal (output value) decreases as the reflection intensity decreases. FIGS. 3A and B are descriptive diagrams illustrating the detection of the position of a color pattern by the sensor 40. The reflectance of light by the color pattern is lower than the reflectance of light at the surface of the intermediate transfer belt 8. Accordingly, when the color pattern enters into the detection area of the sensor 40, the optical intensity of the regularly-reflected light received by the sensor 40 drops. A comparator 72 (FIG. 4) compares the detection signal with a threshold. Then, on the basis of the comparison result, the comparator 72 (FIG. 4) outputs a binary signal constituted by a low-level signal and a high-level signal. A CPU 70 (FIG. 4) finds the timing at which the binary signal output from the comparator 72 (FIG. 4) changes from low-level to high-level (a rising edge) and the timing at which the binary signal changes from high-level to low-level (a falling edge). The CPU 70 (FIG. 4) then finds the position of the color pattern on the basis of a center position 30 between the rising edge and the falling edge. The CPU 70 (FIG. 4) detects the center position 30 of the binary signal as the position of that color pattern. The CPU 70 (FIG. 4) detects the relative positions of the plurality of color patterns on the basis of the center positions of the respective color patterns measured by the sensor 40. Here, as illustrated in FIG. 3A, when the density of the color pattern (the amount of adhering toner) is uniform, the waveform of the detection signal will be horizontally symmetrical central to the minimum value (the bottom level) of that waveform. Accordingly, the center position 30 of the binary signal coincides with the central position of the color pattern, regardless of the threshold. On the other hand, as illustrated in FIG. 3B, when the density of the color pattern (the amount of adhering toner) is not uniform, the waveform of the detection signal will be horizontally asymmetrical relative to the minimum value of that waveform. If the waveform of the detection signal is horizontally asymmetrical, the center position 30 of the binary signal will differ from the central position of the color pattern. Accordingly, the central position of the color pattern cannot be detected when the waveform of the detection signal is horizontally asymmetrical. Furthermore, the difference between the center position 30 of the binary signal and the central position of the color pattern changes depending on a difference between the minimum value of the detection signal and the threshold. Accordingly, with the image forming apparatus 1 according to the present embodiment, the threshold is set on the basis of the detection signal for the color pattern so that an amount of the color misregistration can be detected accurately, even if the waveform of the detection signal is not horizontally symmetrical. Note that the threshold for each color pattern is determined in a threshold setting process, which will be described later.

Figure 4:
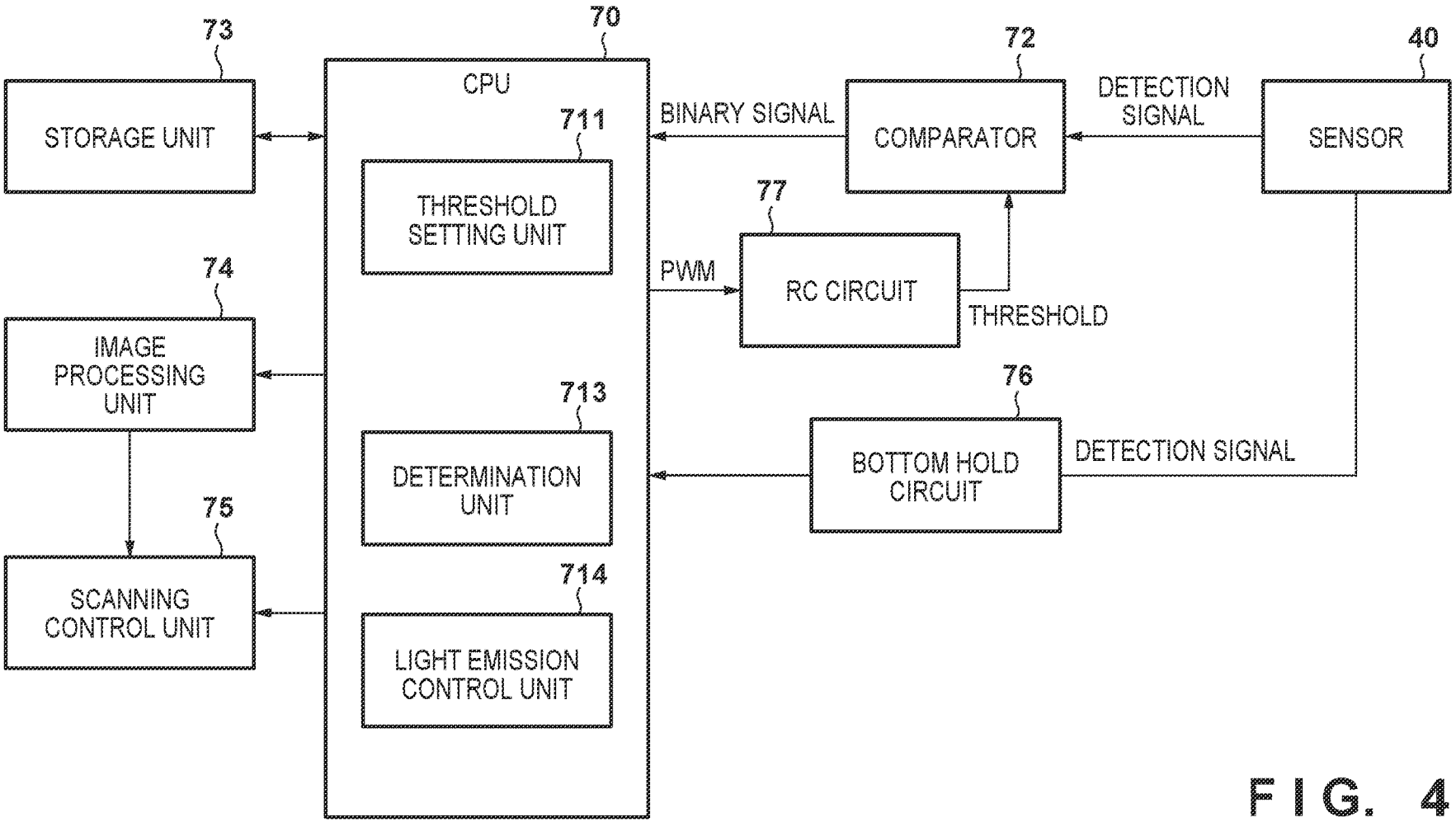
FIG. 4 is a control block diagram of the image forming apparatus according to an embodiment.

FIG. 4 is a control block diagram of the image forming apparatus 1. The CPU 70 is a controller that controls the image forming apparatus 1. A threshold setting unit 711 sets the threshold for the comparator 72. A determination unit 713 finds the relative positions of the plurality of color patterns on the basis of the binary signals. A light emission control unit 714 controls the sensor 40. In the following descriptions, the CPU 70 is a processor that executes the functions (tasks) of the threshold setting unit 711, the determination unit 713, and the light emission control unit 714. The comparator 72 compares the detection signal from the sensor 40 with the threshold, and outputs the binary signal to the CPU 70 on the basis of the comparison result. The threshold setting unit 711 determines the threshold by executing the threshold setting process, generates a pulse width modulation signal (PWM signal) having a duty ratio corresponding to the threshold, and outputs that signal to an RC circuit 77. The RC circuit 77 smoothes the PWM signal from the threshold setting unit 711, and controls the threshold of the comparator 72. Additionally, the detection signal output by the sensor 40 is input to a bottom hold circuit 76. The output of the bottom hold circuit 76 is used in the threshold setting process, which will be described later.

Figure 5A:
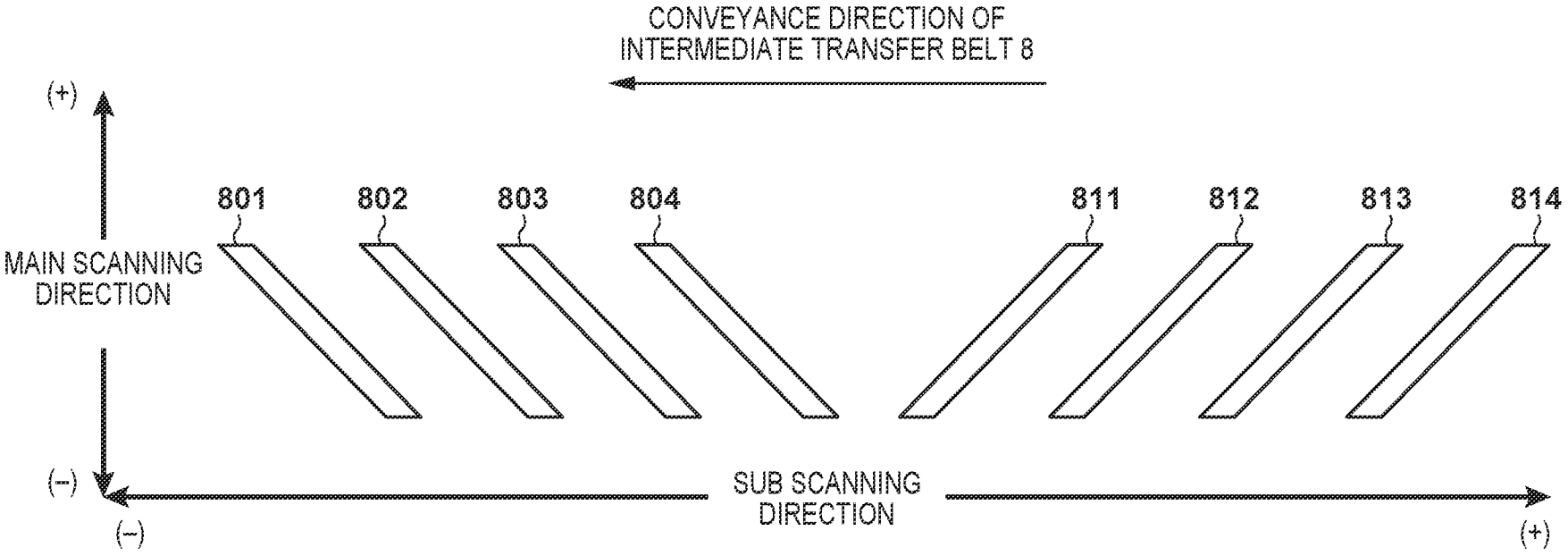
FIG. 5A is a diagram illustrating a color registration pattern according to an embodiment.
Figure 5B:
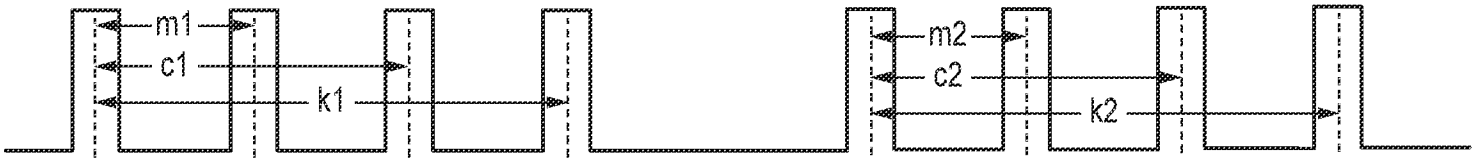
FIG. 5B is a diagram illustrating a binary signal according to an embodiment.

Color registration adjustment will be described next with reference to FIG. 5A and FIG. 5B. FIG. 5A illustrates a color registration pattern. The color registration pattern includes yellow detection patterns 801 and 811, magenta detection patterns 802 and 812, cyan detection patterns 803 and 813, and black detection patterns 804 and 814. The detection patterns are line-shaped toner images angled at 45° relative to a main scanning direction, with the detection patterns 801 to 804 being slanted in the opposite direction from the detection patterns 811 to 814. Here, the main scanning direction corresponds to a direction orthogonal to a direction in which the intermediate transfer belt 8 conveys the detection patterns (a conveyance direction). Note that the conveyance direction is also called a sub scanning direction. FIG. 5B illustrates the binary signal when the color registration patterns are detected. The determination unit 713 detects the distance between the detection pattern of a reference color and a detection pattern of another color aside from the reference color. Accordingly, the determination unit 713 detects a time difference between the center position of the binary signal corresponding to the detection pattern of the reference color and the center position of the binary signal corresponding to the detection pattern of the other color. The following will describe a case where yellow is the reference color. Specifically, the determination unit 713 finds distances m1, c1, and k1 between the detection pattern 801 and the detection patterns 802 to 804, respectively, as well as distances m2, c2, and k2 between the detection pattern 811 and the detection patterns 812 to 814, respectively. These distances are obtained as the products of the time differences between the center positions in the binary signal of the color registration pattern, and the movement speed of the surface of the intermediate transfer belt 8. Note that the center position corresponds to an intermediate time between the time at which the rising edge is detected and the time at which the falling edge is detected.

For example, when the relative positional relationship between the magenta detection pattern and the yellow detection pattern is being successfully controlled to an ideal positional relationship, m1 and m2 are equivalent to corresponding target values. However, if the magenta detection pattern is misregistered in the sub scanning direction relative to the yellow detection pattern, m1 and m2 will be values different from the corresponding target values. Note that when the magenta detection pattern is misregistered toward the + side in the sub scanning direction illustrated in FIG. 5A, m1 and m2 are greater than the target values. On the other hand, when the magenta detection pattern is misregistered toward the − side in the sub scanning direction illustrated in FIG. 5A, m1 and m2 are smaller than the target values. An average value of the difference between the target value and m1 and the difference between the target value and m2 is the amount of the color misregistration in the sub scanning direction. Additionally, when the magenta detection pattern is misregistered in the main scanning direction relative to the yellow detection pattern, one of m1 and m2 is greater than the target value, and the other is smaller than the target value. When the magenta detection pattern is misregistered toward the + side in the main scanning direction in FIG. 5A, m1 is greater than the target value and m2 is smaller than the target value. On the other hand, when the magenta detection pattern is misregistered toward the − side in the main scanning direction in FIG. 5A, m1 is smaller than the target value and m2 is greater than the target value. An average value of the absolute value of the difference between the target value and m1 and the absolute value of the difference between the target value and m2 is the absolute value of the amount of the color misregistration in the main scanning direction. Furthermore, the direction in which the pattern is misregistered in the main scanning direction is determined on the basis of the magnitude relationship between the difference between the target value and m1 and the difference between the target value and m2. The same applies to the other detection patterns as well.

Returning to FIG. 4, the light emission control unit 714 controls the emission of light by the light-emitting unit 51 of the sensor 40. Note that the color registration pattern, image data of threshold setting patterns formed in a threshold setting process, which will be described later, and the like are stored in a storage unit 73 in advance. The thresholds for the respective colors set in the comparator 72, data including the amount of the color misregistration calculated by the determination unit 713, and the like are stored in the storage unit 73 as well. The data of the amount of the color misregistration stored in the storage unit 73 is read out by the CPU 70 with each startup and set in an image processing unit 74. The image processing unit 74 is an ASIC that executes image processing on the image data in order to correct color misregistration in the images formed by the image forming units IMG-Y, IMG-M, IMG-C, and IMG-K. For example, the image processing unit 74 executes image processing for correcting write start positions of the images and image processing for correcting the slants of the images. The image data output from the image processing unit 74 is input to a scanning control unit 75. The scanning control unit 75 forms electrostatic latent images on the photosensitive members 2*a* to 2*d* by controlling the scanning units 5*a* to 5*d*. In addition to correcting color misregistration by executing image processing through the image processing unit 74, the image forming apparatus 1 may also correct image write timings, for example.

Figure 6:
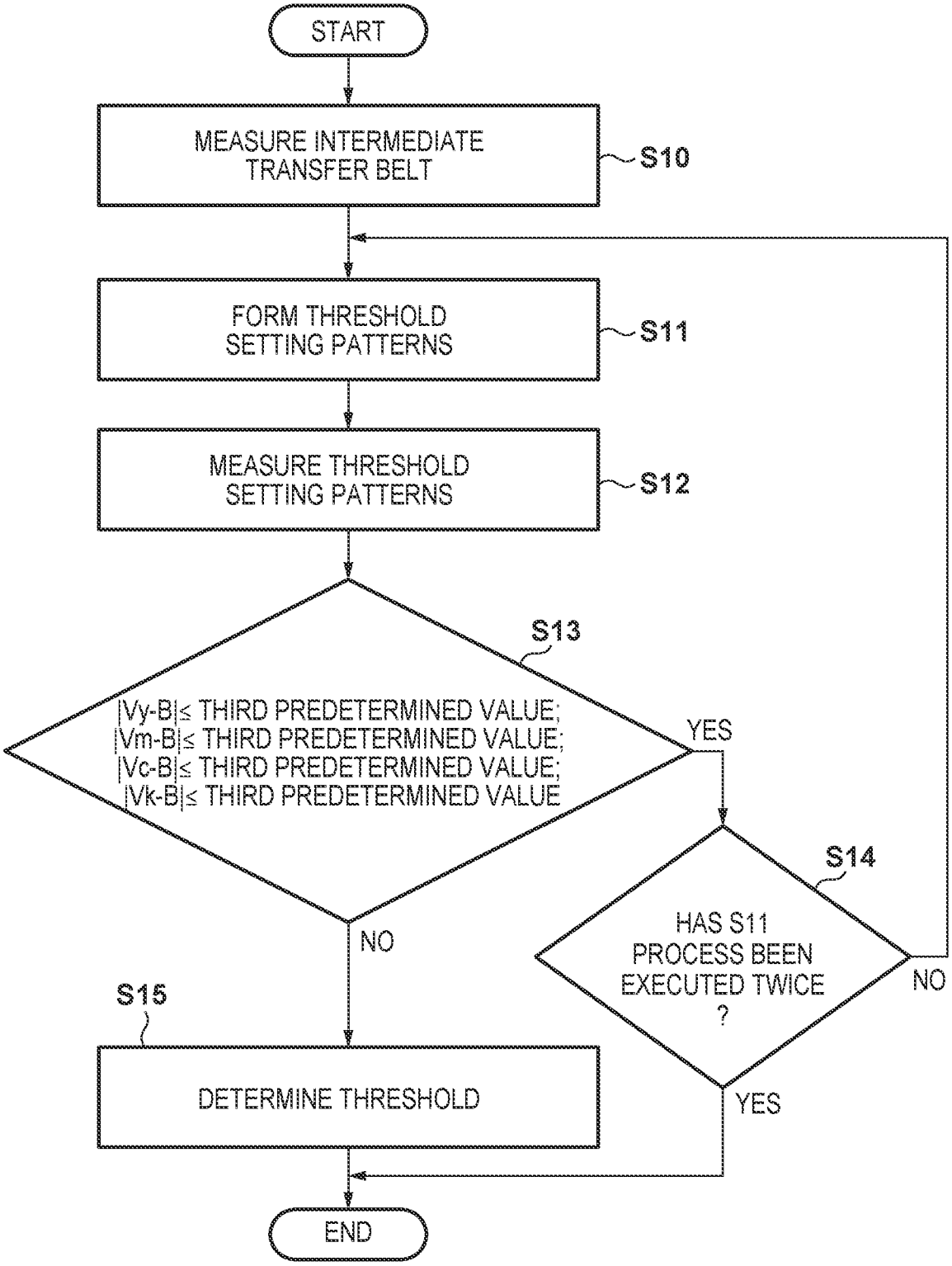
FIG. 6 is a flowchart illustrating a threshold setting process according to an embodiment.
Figure 8:
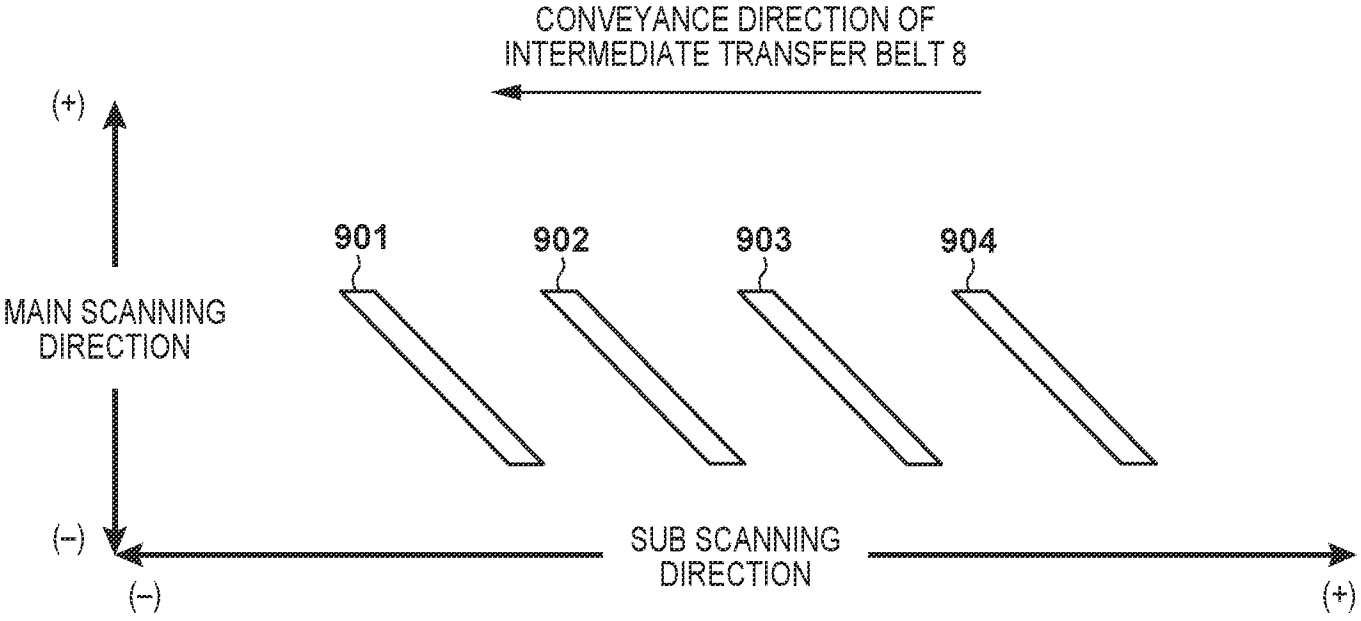
FIG. 8 is a diagram illustrating threshold setting patterns according to an embodiment.

FIG. 6 is a flowchart illustrating the threshold setting process. In step S10, the threshold setting unit 711 measures the light reflected by the intermediate transfer belt 8 using the sensor 40. In step S10, the threshold setting unit 711 samples the detection signal, which is output by the sensor 40 and corresponds to the light reflected by the intermediate transfer belt 8, over a single pass of the intermediate transfer belt 8. The threshold setting unit 711 then stores the average value of the detection signal in the storage unit 73 as a detection result (level B) for the intermediate transfer belt 8. In step S11, the threshold setting unit 711 forms the threshold setting patterns on the intermediate transfer belt 8 by controlling the image forming units IMG-Y, IMG-M, IMG-C, and IMG-K. FIG. 8 illustrates the threshold setting patterns. The threshold setting pattern includes a yellow threshold setting pattern 901, a magenta threshold setting pattern 902, a cyan threshold setting pattern 903, and a black threshold setting pattern 904. Like the color registration patterns 801 to 804, the threshold setting patterns 901 to 904 are formed angled at 45° relative to the conveyance direction of the intermediate transfer belt 8. The threshold setting patterns 901 to 904 are formed in the same order as the color registration patterns 801 to 804. Note that the order of the threshold setting patterns 901 to 904 may differ from the order of the color registration patterns 801 to 804. Additionally, because the bottom hold circuit 76 (FIG. 4) obtains the minimum value of the detection signal in order to set the threshold, the interval at which the threshold setting patterns 901 to 904 are formed is longer than the interval at which the color registration patterns 801 to 804 are formed. In other words, the interval between the threshold setting pattern 901 and the threshold setting pattern 902 is wider than the interval between the color registration pattern 801 and the color registration pattern 802. This makes it possible to suppress a situation where the threshold setting pattern 902 overlaps with the threshold setting pattern 901 and the detection signal of the threshold setting pattern 902 cannot be obtained.

Figure 9:
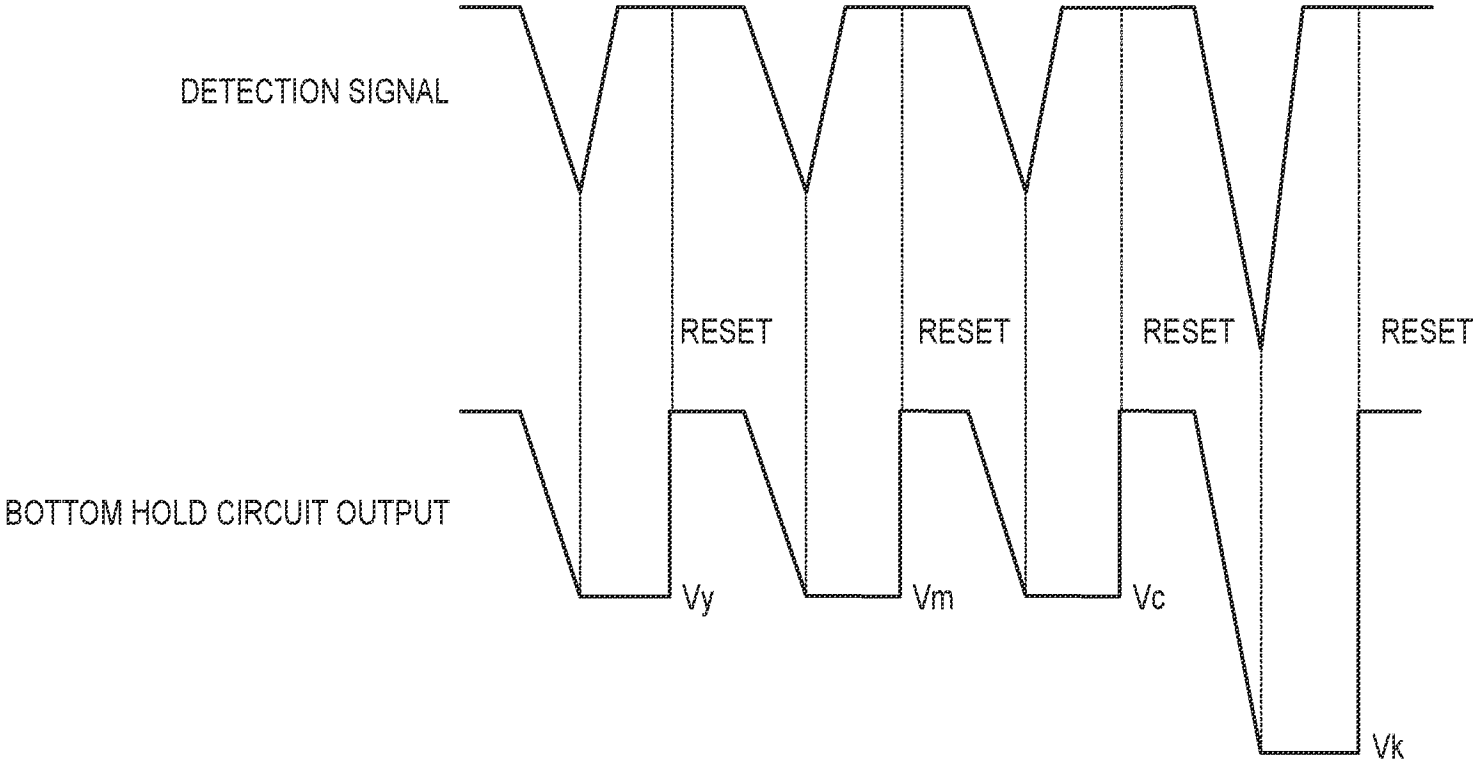
FIG. 9 is a descriptive diagram illustrating an output signal from a bottom hold circuit according to an embodiment.

As illustrated in FIG. 4, the detection signal output by the sensor 40 is output to the bottom hold circuit 76. The bottom hold circuit 76 continues to output the bottom level of the detection signal until a reset signal is input. FIG. 9 illustrates a relationship between the detection signal when the threshold setting patterns 901 to 904 are detected and the signal output from the bottom hold circuit 76. The detection signal from the sensor 40 has the same number of minimum values as there are threshold setting patterns 901 to 904 (four). When the level of the detection signal from the sensor 40 drops in response to the threshold setting patterns 901 to 904 entering into the detection area of the sensor 40, the signal output from the bottom hold circuit 76 also drops. Thereafter, even if the level of the detection signal from the sensor 40 rises, the level of the signal output from the bottom hold circuit 76 stays at the bottom level of the detection signal. When the reset signal is input to the bottom hold circuit 76, the level of the signal output from the bottom hold circuit 76 corresponds to the level of the detection signal from the sensor 40. In step S12, the threshold setting unit 711 measures the threshold setting patterns 901 to 904 using the sensor 40. In step S12, the threshold setting unit 711 obtains bottom levels Vy, Vm, Vc, and Vk of the threshold setting patterns 901 to 904. The bottom level Vy is the bottom level in the detection signal for the yellow threshold setting pattern 901. The bottom level Vm is the bottom level in the detection signal for the magenta threshold setting pattern 902. The bottom level Vc is the bottom level in the detection signal for the cyan threshold setting pattern 903. The bottom level Vk is the bottom level in the detection signal for the black threshold setting pattern 904. Note that the bottom levels Vy, Vm, Vc, and Vk are obtained after the output of the bottom hold circuit 76 has become substantially constant during a predetermined amount of time. The predetermined amount of time is shorter than the amount of time over which the threshold setting pattern passes through the detection area of the sensor 40. In other words, the threshold setting unit 711 obtains the signal output by the bottom hold circuit 76 (the bottom level) each time the threshold setting pattern passes through the detection area of the sensor 40. Then, the threshold setting unit 711 inputs the reset signal to the bottom hold circuit 76 each time the threshold setting pattern finishes passing through the detection area of the sensor 40.

In step S13, the threshold setting unit 711 finds differences between the bottom levels Vy, Vm, Vc, and Vk and the level B (the detection signal value corresponding to the intermediate transfer belt 8), and determines whether or not any of the differences are within a third predetermined value. Normally, regularly-reflected light from a pattern is weaker than regularly-reflected light from the surface of the intermediate transfer belt 8. Accordingly, when the differences between the bottom levels Vy, Vm, Vc, and Vk and the level B are within the third predetermined value, it is possible that a problem has arisen in the formation, detection, or the like of the threshold setting patterns. Thus in such a case, the threshold setting unit 711 determines, in step S14, whether or not the process of step S11 has already been carried out twice. If the process of step S11 has not been carried out twice, the threshold setting unit 711 moves the process to step S11. However, if in step S14 the process of step S11 has already been carried out twice, the threshold setting unit 711 makes an error notification in a display unit, which is not shown, and ends the threshold setting process. Note that the third predetermined value is set in advance through experiments. The third predetermined value is stored in the storage unit 73. On the other hand, if none of the differences between the bottom levels Vy, Vm, Vc, and Vk and the level B are within the third predetermined value in step S13, the threshold setting unit 711 determines the thresholds for the respective colors in step S15. Note that the determined thresholds are stored in the storage unit 73.

Figure 7:
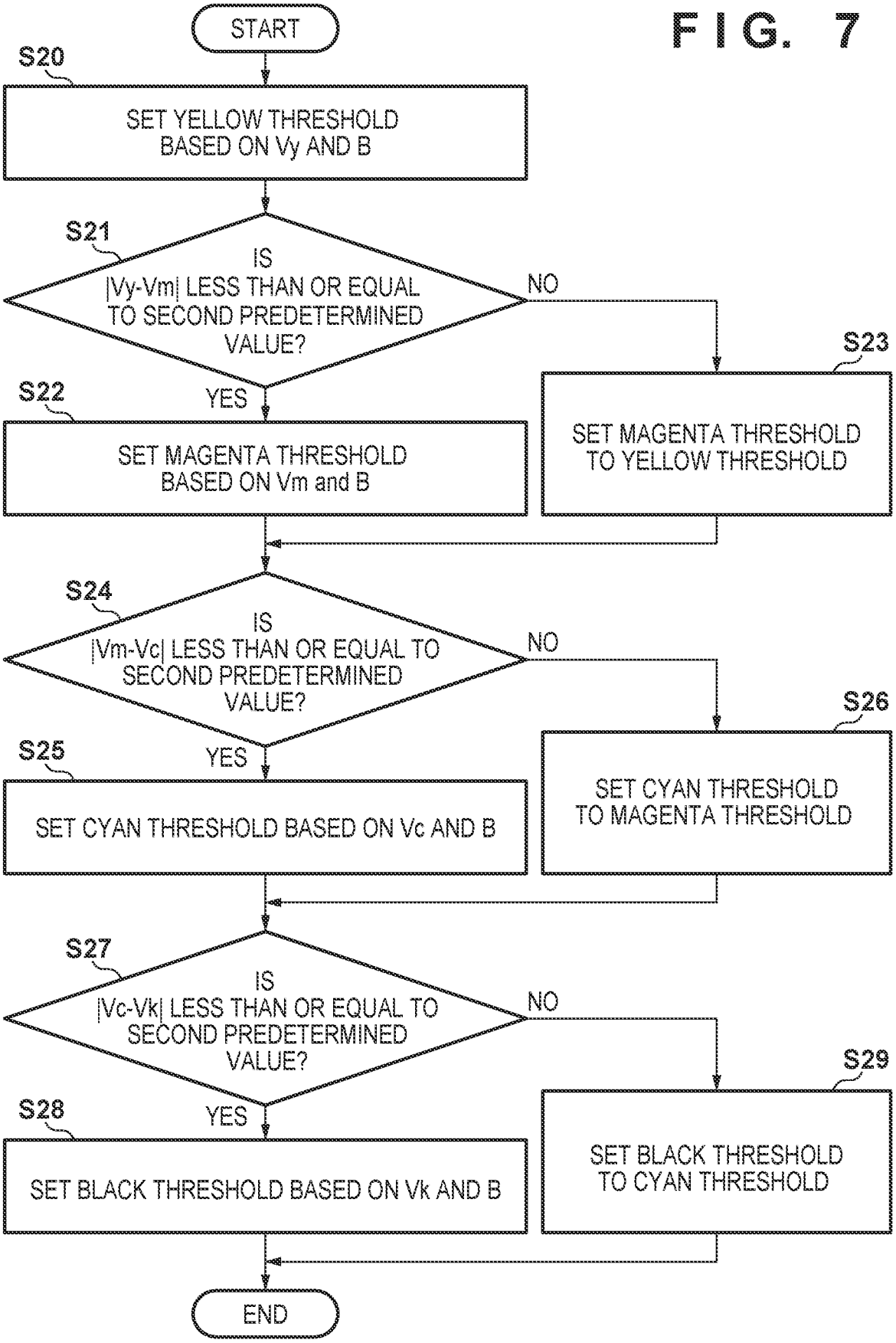
FIG. 7 is a flowchart illustrating a threshold setting process according to an embodiment.

FIG. 7 is a flowchart illustrating a method for determining the thresholds in the aforementioned step S15. First, in step S20, the threshold setting unit 711 sets a threshold for binarizing the detection signals for the yellow color registration patterns 801 and 811 as follows.

$$\text{yellow threshold}=(B-Vy)\times 0.5+Vy \quad (1)$$

The above Expression (1) sets a median value (50%) between the detection signal for the intermediate transfer belt 8 (the level B) and the detection signal for the yellow threshold setting pattern 901 (the bottom level Vy) as the threshold for yellow. Note that the threshold for the yellow color registration patterns 801 and 811 need not be the median value as long as it is a value between the detection signal for the intermediate transfer belt 8 (the level B) and the detection signal for the yellow threshold setting pattern 901 (the bottom level Vy). In step S21, the threshold setting unit 711 determines whether the absolute value of the difference between the detection signal for the yellow threshold setting pattern 901 (the bottom level Vy) and the detection signal for the magenta threshold setting pattern 902 (the bottom level Vm) is less than or equal to a second predetermined value. This is a process for determining whether or not a switch between the thresholds will be in time if the yellow color registration pattern 801 and the magenta color registration pattern 802, which is adjacent to the yellow color registration pattern 801, are measured in sequence by the sensor 40. This is also a process for determining whether or not a switch between the thresholds will be in time if the yellow color registration pattern 811 and the magenta color registration pattern 812, which is adjacent to the yellow color registration pattern 811, are measured in sequence by the sensor 40. If the absolute value of the difference between the bottom level Vy and the bottom level Vm is less than or equal to the second predetermined value, in step S22, the threshold setting unit 711 sets the threshold for binarizing the detection signals for the magenta color registration patterns 802 and 812 as follows. The threshold for binarizing the detection signals for the magenta color registration patterns 802 and 812 is found by replacing the bottom level Vy with the bottom level Vm in Expression (1). On the other hand, if the absolute value of the difference between the yellow bottom level Vy and the magenta bottom level Vm is not less than or equal to the second predetermined value, it is determined that the switch in the thresholds will not be in time. Accordingly, in step S23, the threshold setting unit 711 sets the threshold for the magenta color registration patterns 802 and 812 to the same level as the threshold for the yellow color registration patterns 801 and 811. Thereafter, in the same manner, the threshold setting unit 711 determines, in step S24, whether or not the absolute value of the difference between the detection signal for the magenta threshold setting pattern 902 (the bottom level Vm) and the detection signal for the cyan threshold setting pattern 903 (the bottom level Vc) is less than or equal to the second predetermined value. If the absolute value of the difference between the bottom level Vm and the bottom level Vc is less than or equal to the second predetermined value, in step S25, the threshold setting unit 711 sets the threshold for the cyan color registration patterns 803 and 813 as follows. The threshold for binarizing the detection signals for the cyan color registration patterns 803 and 813 is found by replacing the bottom level Vy with the bottom level Vc in Expression (1). On the other hand, if the absolute value of the difference between the magenta bottom level Vm and the cyan bottom level Vc is not less than or equal to the second predetermined value, it is determined that the switch in the thresholds will not be in time. Accordingly, in step S26, the threshold setting unit 711 sets the cyan threshold to the same level as the magenta threshold. Here, if the threshold for the magenta color registration patterns 802 and 812 is set to the same value as the threshold for the yellow color registration patterns 801 and 811, the threshold for the cyan color registration patterns 803 and 813 is set to the same value as the yellow threshold. Furthermore, the threshold setting unit 711 determines, in step S27, whether or not the absolute value of the difference between the detection signal for the cyan threshold setting pattern 903 (the bottom level Vc) and the detection signal for the black threshold setting pattern 904 (the bottom level Vk) is less than or equal to the second predetermined value. If the absolute value of the difference between the bottom level Vc and the bottom level Vk is less than or equal to the second predetermined value, in step S28, the threshold setting unit 711 sets the threshold for the black color registration patterns 804 and 814 as follows. The threshold for binarizing the detection signals for the black color registration patterns 804 and 814 is found by replacing the bottom level Vy with the bottom level Vk in Expression (1). On the other hand, if the absolute value of the difference between the cyan bottom level Vc and the black bottom level Vk is not less than or equal to the second predetermined value, it is determined that the switch in the thresholds will not be in time. Accordingly, in step S29, the threshold setting unit 711 sets the threshold for the black color registration patterns 804 and 814 to the same level as the threshold for the cyan color registration patterns 803 and 813. Here, if the threshold for the cyan color registration patterns 803 and 813 is set to the same level as the threshold for the magenta color registration patterns 802 and 812, the threshold for the black color registration patterns 804 and 814 is set to the same value as the magenta threshold. Furthermore, if the threshold for the magenta color registration patterns 802 and 812 is set to the same level as the threshold for the yellow color registration patterns 801 and 811, the threshold for the black color registration patterns 804 and 814 is set to the same value as the yellow threshold.

Hereinafter, a configuration in which a toner image of a second color is formed upstream, in the rotation direction of the intermediate transfer belt 8, from a color registration pattern of a first color, will be described as an example. The threshold setting unit 711 determines whether or not to change the threshold for detecting the color registration pattern of the second color on the basis of a difference between the detection signal value of a threshold setting pattern formed using toner of the first color and the detection signal value of a threshold setting pattern formed using toner of the second color. For example, the threshold setting unit 711 determines whether or not to change the threshold for detecting the magenta color registration patterns 802 and 812 on the basis of whether or not the absolute value of the difference between the bottom level Vy and the bottom level Vm is less than or equal to the second predetermined value. If the absolute value of the difference between the bottom level Vy and the bottom level Vm is less than or equal to the second predetermined value, the threshold setting unit 711 determines the threshold for the magenta color registration patterns 802 and 812 from the bottom level Vm and the level B, on the basis of Expression (1). This is because it is possible that the detection waveform of the detection pattern of the first color will be analogous to the detection waveform of the detection pattern of the second color. When the threshold is set on a color-by-color basis to, for example, a median value of the detection signal value pertaining to the intermediate transfer belt 8 (the level B) and the detection signal value pertaining to the threshold setting pattern for each color (the bottom level), the determination unit 713 can find the amount of the color misregistration with a high level of accuracy. On the other hand, if the absolute value of the difference between the bottom level Vy and the bottom level Vm is greater than the second predetermined value, the threshold setting unit 711 sets the threshold for the magenta color registration patterns 802 and 812 on the basis of the bottom level Vy and the level B corresponding to the intermediate transfer belt 8. In other words, the threshold setting unit 711 does not change the threshold for the color registration pattern of the second color from the threshold for the color registration pattern of the first color. This is because the threshold may not be switched in time between when the color registration pattern of the first color passes through the detection position of the sensor 40 to when the detection pattern of the second color arrives at the detection position. In other words, when the absolute value of the difference between the bottom level of the threshold setting pattern of the first color and the bottom level of the threshold setting pattern of the second color is greater than the second predetermined value, the threshold setting unit 711 determines that the threshold will not be switched in time, and prohibits the threshold from being changed. Additionally, the configuration may be such that when the absolute value of the difference between the bottom level Vm and the bottom level Vc is greater than the second predetermined value, the threshold setting unit 711 sets the threshold for the cyan color registration pattern 803 to the same value as the threshold for the yellow color registration pattern 801. Furthermore, the configuration may be such that when the absolute value of the difference between the bottom level Vc and the bottom level Vk is greater than the second predetermined value, the threshold setting unit 711 sets the threshold for the black color registration pattern 804 to the same value as the threshold for the magenta color registration pattern 802.

As described above, the comparator 72 binarizes the detection signal from the sensor 40 using the threshold controlled by the RC circuit 77. While the color registration pattern of the first color is passing through the detection area of the sensor 40, the threshold setting unit 711 outputs a PWM signal corresponding to the threshold for the color registration pattern of the first color. The RC circuit 77 smoothes the PWM signal, and controls the threshold of the comparator 72 to the threshold for the color registration pattern of the first color. Then, after the color registration pattern of the first color has passed through the detection area of the sensor 40, the threshold setting unit 711 outputs a PWM signal corresponding to the threshold for the color registration pattern of the second color. As a result, the RC circuit 77 changes the threshold of the comparator 72 from the threshold for the color registration pattern of the first color to the threshold for the color registration pattern of the second color. However, it takes some time for the threshold of the comparator 72 to converge on the threshold for the color registration pattern of the second color. When the difference between the threshold for the color registration pattern of the first color and the threshold for the color registration pattern of the second color is great, the color registration pattern of the second color may arrive at the detection area of the sensor 40 before the threshold of the comparator 72 converges on the threshold for the color registration pattern of the second color. In this case, the threshold at the timing when the binary signal corresponding to the color registration pattern of the second color changes from low-level to high-level is different from the threshold at the timing when the binary signal changes from high-level to low-level. This produces error in the binary signal, and the amount of the color misregistration therefore cannot be found with a high level of accuracy.

Note that the difference between the threshold for the color registration pattern of the first color and the threshold for the color registration pattern of the second color, which is found through Expression (1), is half the difference between the bottom level of the detection signal pertaining to the threshold setting pattern of the first color and the level of the detection signal pertaining to the intermediate transfer belt 8. The second predetermined value is assumed to be, for example, a value less than or equal to twice a maximum amount of variation (a first predetermined value) at which the output from the RC circuit 77 can stabilize in the time from when the color registration pattern of the first color passes through the detection area of the sensor 40 to when the color registration pattern of the second color arrives at the detection area of the sensor 40. In this case, if the difference between the bottom level of the detection signal pertaining to the threshold setting pattern of the first color and the bottom level of the detection signal pertaining to the threshold setting pattern of the second color is less than or equal to the second predetermined value, the difference between the threshold for the first color and the threshold for the second color found through Expression (1) will be less than the first predetermined value. Accordingly, the output from the RC circuit 77 finishes changing from the threshold for the first color to the threshold for the second color between when the following end of the color registration pattern of the first color passes through the detection area of the sensor 40 to when the leading end of the color registration pattern of the second color arrives at the detection area of the sensor 40. On the other hand, if the difference between the bottom level of the detection signal pertaining to the threshold setting pattern of the first color and the bottom level of the detection signal pertaining to the threshold setting pattern of the second color is greater than the second predetermined value, the difference between the threshold for the first color and the threshold for the second color found through Expression (1) will be greater than the first predetermined value. In this case, the output from the RC circuit 77 does not finish changing from the threshold for the first color to the threshold for the second color between when the following end of the color registration pattern of the first color passes through the detection area of the sensor 40 to when the leading end of the color registration pattern of the second color arrives at the detection area of the sensor 40. Accordingly, if the difference between the bottom level of the detection signal pertaining to the threshold setting pattern of the first color and the bottom level of the detection signal pertaining to the threshold setting pattern of the second color is greater than the second predetermined value, the threshold setting unit 711 sets the threshold for the second color to the same value as the threshold for the first color. In other words, the threshold setting unit 711 does not change the PWM signal input to the RC circuit 77, so that the threshold is not changed. As a result, the comparator 72 converts the detection signal of the color registration pattern of the second color to a binary signal on the basis of the threshold for the first color. Accordingly, detection error arising as a result of the threshold changing while the color registration pattern of the second color is being detected can be suppressed.

Expression (1) sets the median value between the level B of the detection signal pertaining to the intermediate transfer belt 8 and the bottom level Vy of the detection signal pertaining to the threshold setting pattern as the threshold, and thus the second predetermined value is set to a value less than or equal to twice the first predetermined value. However, if the multiplier of 0.5 in Expression (1) is set to 0.25, the second predetermined value will be of value less than or equal to four times the first predetermined value. In other words, the second predetermined value is a value found on the basis of a relationship between the first predetermined value and the multiplier in Expression (1). Note that the first predetermined value corresponds to the maximum amount of variation at which the output from the RC circuit 77 can stabilize during the detection interval of the color registration pattern.

Meanwhile, if the difference between the bottom level of the detection signal pertaining to the threshold setting pattern of the first color and the bottom level of the detection signal pertaining to the threshold setting pattern of the second color is greater than the second predetermined value, the threshold for the second color may be set to a value obtained by increasing/reducing the threshold for the first color by a value equivalent to less than or equal to the first predetermined value. In other words, it is sufficient for the difference between the threshold for the color registration pattern of a given color, and the threshold for the color registration pattern of another color formed upstream from the color registration pattern of the given color, to be less than or equal to the first predetermined value. The threshold setting unit 711 can determine whether to increase or reduce the threshold for the first color by the first predetermined value on the basis of the magnitude relationship between the bottom level of the detection signal pertaining to the threshold setting pattern for the first color and the bottom level of the detection signal pertaining to the threshold setting pattern for the second color. Specifically, when the absolute value of the bottom level Vm is greater than the absolute value of the bottom level Vy, the threshold setting unit 711 reduces the threshold for the color registration patterns 802 and 812 from the threshold for the color registration patterns 801 and 811 by an amount equivalent to the first predetermined value. In other words, the threshold for the color registration patterns 802 and 812 is shifted, toward the bottom level Vm side, from the threshold for the color registration patterns 801 and 811. Conversely, when the absolute value of the bottom level Vm is less than the absolute value of the bottom level Vy, the threshold setting unit 711 increases the threshold for the color registration patterns 802 and 812 from the threshold for the color registration patterns 801 and 811 by an amount equivalent to the first predetermined value. In other words, the threshold for the color registration patterns 802 and 812 is shifted, toward the level B side, from the threshold for the color registration patterns 801 and 811.

In the flowchart of FIG. 7, the threshold setting unit 711 determines whether to use the threshold obtained from Expression (1), or to use the same threshold as the threshold for the color registration pattern one place further on the downstream side, on the basis of a comparison with the bottom level of the detection signal pertaining to the threshold setting pattern one place further on the downstream side. However, if any one of absolute values Vy−Vm, Vm−Vc, and Vc−Vk of the bottom level differences is greater than the second predetermined value, the threshold setting unit 711 may set all to the same threshold. In this case, the threshold setting unit 711 sets the thresholds for the color registration patterns 802 to 804 and 812 to 814 to the threshold for the yellow color registration patterns 801 and 811, for example.

Figure 10:
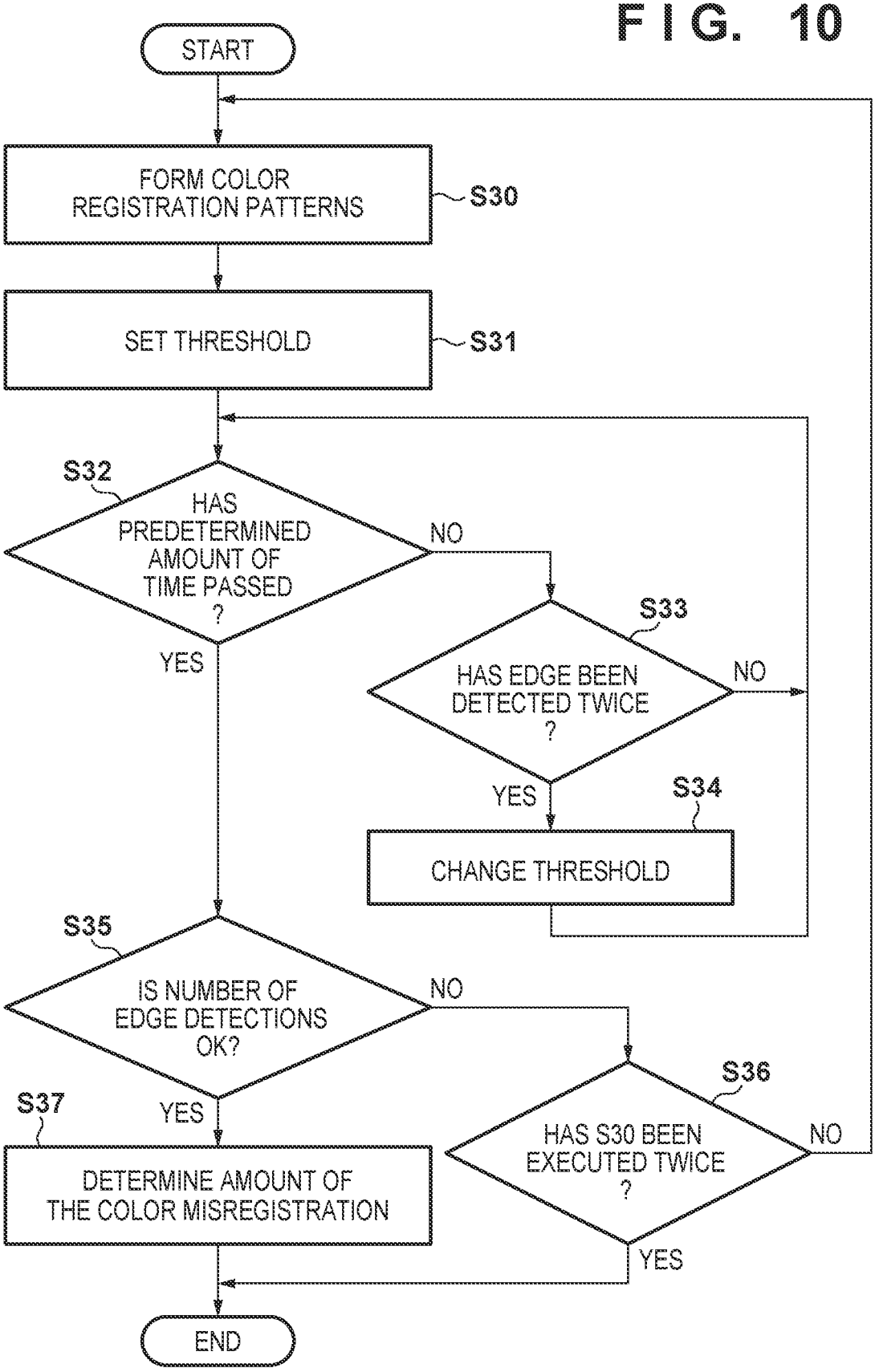
FIG. 10 is a flowchart illustrating color registration adjustment according to an embodiment.

FIG. 10 is a flowchart illustrating a determination process in the color registration adjustment. The CPU 70 executes the color registration adjustment after, for example, the main power of the image forming apparatus 1 has been turned on, the image forming apparatus 1 has formed images on a predetermined number of sheets following the previous execution of the color registration adjustment, or the like. For example, when the color registration adjustment is to be executed, the threshold setting process (FIG. 6) is carried out before the color registration adjustment (FIG. 10). Then, the CPU 70 uses the threshold set through the threshold setting process in the color registration adjustment (FIG. 10). However, the threshold setting unit 711 need not be configured to carry out the threshold setting process each time the color registration adjustment is executed. For example, the threshold set in the previous threshold setting process (FIG. 6) is used in the color registration adjustment (FIG. 10).

In step S30, the determination unit 713 forms the color registration patterns (FIG. 5A) on the intermediate transfer belt 8 by controlling the image forming units IMG-Y, IMG-M, IMG-C, and IMG-K. Ten sets of the color registration patterns are formed, for example. At this time, the light emission control unit 714 controls the sensor 40 to a state in which the color registration patterns can be detected. In step S31, the threshold setting unit 711 sets the threshold of the comparator 72 to the threshold for the yellow detection pattern 801. In other words, in step S31, the threshold setting unit 711 outputs a PWM signal corresponding to the threshold for the yellow detection pattern 801. The RC circuit 77 smoothes the PWM signal and controls the threshold of the comparator 72. Next, in step S32, the determination unit 713 determines whether or not an amount of time sufficient for the color registration pattern to be detected (a predetermined amount of time) has passed. If in step S32 the predetermined amount of time has not passed, the CPU 70 determines, in step S33, whether an edge of the binary signal has been detected twice. If the edge of the binary signal has not been detected twice in step S33, the determination unit 713 moves the process to step S32. If, however, the edge of the binary signal has been detected twice in step S33, the threshold setting unit 711 changes the threshold of the comparator 72 to the threshold for the magenta detection pattern 802 in step S34. Next, the determination unit 713 moves the process to step S32. In other words, by repeating the processing from step S32 to step S34, the threshold setting unit 711 changes the threshold of the comparator each time the edge of the binary signal is detected twice. Because the order in which the color registration patterns pass through the detection area of the sensor 40 is set in advance, the threshold setting unit 711 changes the threshold of the comparator 72 to the threshold for the next color registration pattern each time the edge of the binary signal is detected twice. After the predetermined amount of time has passed in step S32, the determination unit 713 determines whether or not the edge of the binary signal has been detected a predetermined number of times in step S35. When ten sets of the color registration patterns (FIG. 5A) are formed, the determination unit 713 determines whether or not the edge of the binary signal has been detected 160 times. If the edge of the binary signal has been detected 160 times, the determination unit 713 calculates the amount of the color misregistration in step S37. Note that when a plurality of sets of the color registration patterns indicated in FIG. 5A are formed, an average value of the amounts of the color misregistration found for the respective detection patterns is used as the amount of the color misregistration. The determination unit 713 then ends the color registration adjustment process. On the other hand, if the edge of the binary signal has not been detected 160 times in step S35, the determination unit 713 determines whether or not the process of step S30 has been executed twice. If the process of step S30 has not been executed twice, the determination unit 713 moves the process to step S30. On the other hand, if in step S36 the process of step S30 has already been executed twice, the determination unit 713 displays guidance, for notifying a user of an error, in a screen, which is not shown, and ends the process of the color registration adjustment. In other words, the determination unit 713 attempts to obtain the amount of the color misregistration until an error has occurred three times in a row. Note that the determination unit 713 does not calculate the amount of the color misregistration until the number of edges of the binary signal reaches 160. In this case, the image processing unit 74 executes the image processing on the basis of the amount of the color misregistration stored in the storage unit 73 the previous time.

As described thus far, the threshold setting unit 711 sets the threshold so that variation in the threshold, arising as the patterns of the respective colors pass through the detection area of the sensor 40, is less than or equal to a predetermined value, which makes it possible to suppress detection error in the color registration adjustment with a low-cost configuration.

Second Embodiment

The present embodiment will be described next, focusing on the differences from the first embodiment. In the first embodiment, the threshold is set in a color-by-color basis. However, the differences between the bottom levels Vy, Vm, and Vc of the detection signals pertaining to the threshold setting patterns 901, 902, and 903 for the chromatic colors are not particularly great. On the other hand, the difference between the bottom levels Vy, Vm, and Vc and the bottom level Vk is great. Accordingly, in the threshold setting process according to the present embodiment, only two thresholds, namely a threshold for the color registration patterns 801, 802, 803, 811, 812, and 813 of the chromatic colors and a threshold for the black color registration patterns 804 and 814, are determined. In this case, the threshold setting unit 711 finds an average Vymc of the bottom levels Vy, Vm, and Vc, and takes a value found by replacing the bottom level Vy in Expression (1) with the average Vymc as the threshold for the color registration patterns 801, 802, 803, 811, 812, and 813 of the chromatic colors. Then, on the basis of a difference between the average Vymc and the bottom level Vk, the threshold setting unit 711 sets the threshold for the black color registration patterns 804 and 814 to the bottom level Vk, or to the same threshold as the threshold for the color registration patterns of the chromatic colors. In the determination process of FIG. 10, the threshold setting unit 711 first sets the threshold for the color registration patterns of the chromatic colors, and then, once six edges have been detected, changes the threshold to the threshold for the black color registration pattern. Then, once two edges have been detected, the threshold setting unit 711 changes the threshold back to the threshold for the color registration patterns of the chromatic colors. The threshold setting unit 711 repeats the above-described threshold change twice. Note that the configuration may be such that when the threshold for the color registration patterns of the chromatic colors is set to the threshold for the black color registration pattern, only the yellow threshold setting pattern 901 and the black threshold setting pattern 904 are formed as the threshold setting patterns, for example. In this case, a value found on the basis of Expression (1) is used as the threshold for the color registration patterns of the chromatic colors. Furthermore, the configuration may be such that the threshold setting patterns for two of the three chromatic colors and the black threshold setting pattern are formed. Note that if the threshold setting patterns for two of the chromatic colors are formed, the threshold for the color registration patterns of the chromatic colors is set to a value between the average of the bottom levels of the threshold setting patterns of the two chromatic colors and the level B of the detection signal pertaining to the intermediate transfer belt 8.

As described thus far, the threshold setting unit 711 sets the threshold so that variation in the threshold, arising as the patterns of the respective colors pass through the detection area of the sensor 40, is less than or equal to a predetermined value, which makes it possible to suppress detection error in the color registration adjustment with a low-cost configuration.

Third Embodiment

The threshold setting unit 711 according to the first embodiment determines the thresholds for the color registration patterns 801 to 814 on the basis of the bottom levels Vy, Vm, Vc, and Vk of the detection signals corresponding to the threshold setting patterns 901, 902, 903, and 904. The threshold setting unit 711 according to the second embodiment determines the threshold on the basis of the bottom levels of the detection signals corresponding to the threshold setting patterns of the chromatic colors and the bottom level of the detection signal corresponding to the black threshold setting pattern.

The threshold setting unit 711 according to the present embodiment compares durations of the binary signals obtained by conversion from the detection signals for the threshold setting patterns 901, 902, 903, and 904, and determines the thresholds for the color registration patterns 801 to 814 on the basis of the comparison result. In other words, the threshold setting unit 711 converts the threshold setting patterns 901, 902, 903, and 904 to the binary signal on the basis of a threshold TH set in advance. The threshold setting unit 711 calculates a time Time, for which the high-level signal is output on the basis of the binary signal, for each of the threshold setting patterns 901, 902, 903, and 904. Then, the threshold setting unit 711 determines whether or not the absolute value of a difference between a time Time_y corresponding to the threshold setting pattern 901 and a time Time_m corresponding to the threshold setting pattern 902 is longer than a predetermined amount of time. If the absolute value of the difference between the time Time_y and the time Time_m is longer than the predetermined amount of time, the threshold setting unit 711 sets the threshold for the magenta color registration patterns 802 and 812 to the threshold for the yellow color registration patterns 801 and 811. Note that the threshold for the yellow color registration patterns 801 and 811 is determined on the basis of the bottom level Vy and the level B, using Expression (1) described in the first embodiment. The threshold determined here is also set as the threshold for the magenta color registration patterns 802 and 812.

On the other hand, if the absolute value of the difference between the time Time_y and the time Time_m is not longer than the predetermined amount of time, the threshold setting unit 711 determines the threshold for the magenta color registration patterns 802 and 812 on the basis of the bottom level Vm and the level B. Note that the threshold for the yellow color registration patterns 801 and 811 is determined on the basis of the bottom level Vy and the level B, using Expression (1) described in the first embodiment. On the other hand, the threshold for the magenta color registration patterns 802 and 812 is determined on the basis of the bottom level Vm and the level B, using Expression (1) described in the first embodiment.

Likewise, the threshold setting unit 711 determines whether or not the absolute value of a difference between the time Time_m corresponding to the threshold setting pattern 902 and a time Time_c corresponding to the threshold setting pattern 903 is longer than a predetermined value. If the absolute value of the difference between the time Time_m and the time Time_c is longer than the predetermined amount of time, the threshold setting unit 711 sets the threshold for the cyan color registration patterns 803 and 813 to the threshold for the magenta color registration patterns 802 and 812. The threshold for the cyan color registration patterns 803 and 813 is set to the same value as the threshold for the magenta color registration patterns 802 and 812.

On the other hand, if the absolute value of the difference between the time Time_m and the time Time_c is not longer than the predetermined amount of time, the threshold setting unit 711 determines the threshold for the cyan color registration patterns 803 and 813 on the basis of the bottom level Vc and the level B, using Expression (1) according to the first embodiment.

Likewise, the threshold setting unit 711 determines whether or not the absolute value of a difference between the time Time_c corresponding to the threshold setting pattern 903 and a time Time_k corresponding to the threshold setting pattern 904 is longer than a predetermined value. If the absolute value of the difference between the time Time_c and the time Time_k is longer than the predetermined amount of time, the threshold setting unit 711 sets the threshold for the black color registration patterns 804 and 814 to the threshold for the cyan color registration patterns 803 and 813. In other words, the threshold for the black color registration patterns 804 and 814 is set to the same value as the threshold for the cyan color registration patterns 803 and 813.

On the other hand, if the absolute value of the difference between the time Time_c and the time Time_k is not longer than the predetermined amount of time, the threshold setting unit 711 determines the threshold for the black color registration patterns 804 and 814 on the basis of the bottom level Vk and the level B, using Expression (1) according to the first embodiment.

As described thus far, the threshold setting unit 711 sets the threshold so that variation in the threshold, arising as the patterns of the respective colors pass through the detection area of the sensor 40, is less than or equal to a predetermined value, which makes it possible to suppress detection error in the color registration adjustment with a low-cost configuration.

Additionally, the image forming apparatus 1 is not limited to a configuration in which the functions of the threshold setting unit 711, the determination unit 713, and the light emission control unit 714 are realized by the CPU 70. For example, the functions of the threshold setting unit 711, the determination unit 713, and the light emission control unit 714 may be at least partially realized by an ASIC different from the CPU 70. Alternatively, all of the functions of the threshold setting unit 711, the determination unit 713, and the light emission control unit 714 may be realized by an ASIC different from the CPU 70. The number of ASICs is not limited to 1. In other words, the image forming apparatus 1 may be configured such that an ASIC for realizing the function of the threshold setting unit 711, an ASIC for realizing the function of the determination unit 713, and an ASIC for realizing the function of the light emission control unit 714 are different ASICs. Additionally, the functions of the threshold setting unit 711, the determination unit 713, and the light emission control unit 714 may be at least partially realized by a processor different from the CPU 70. Alternatively, all of the functions of the threshold setting unit 711, the determination unit 713, and the light emission control unit 714 may be realized by a processor different from the CPU 70. The number of processors different from the CPU 70 is not limited to 1. In other words, the image forming apparatus 1 may be configured such that a processor for realizing the function of the threshold setting unit 711, a processor for realizing the function of the determination unit 713, and a processor for realizing the function of the light emission control unit 714 are different processors.

Additionally, the image forming apparatus 1 according to the first embodiment, the second embodiment, and the third embodiment includes the intermediate transfer belt 8. However, the image forming apparatus 1 is not limited to a configuration that includes the intermediate transfer belt 8, and the image forming apparatus 1 may instead be configured so as to include an intermediate transfer drum. The intermediate transfer belt 8, the intermediate transfer drum, and the like are called intermediate transfer members. The intermediate transfer member can rotate in a predetermined direction and convey a pattern to the detection area of the sensor 40.

According to the present invention, in an image forming apparatus that carries out color registration adjustment by using thresholds of respective colors to determine the positions of toner images, error in the detection of the positions of the toner images can be reduced.

Other Embodiments

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An image forming apparatus comprising:

a plurality of image forming units configured to form images, each having a different color;

an intermediate transfer member configured to be rotated in a predetermined direction;

a sensor configured to measure reflected light from a color pattern formed on the intermediate transfer member;

a comparator configured to compare an output value from the sensor with a threshold value; and a controller configured to execute:

a first image formation task that forms a plurality of first color patterns having different colors by controlling the plurality of image forming units;

a first measurement task that measures the plurality of first color patterns by controlling the sensor;

a determination task that, on the basis of a first output value corresponding to a measurement result of the plurality of first color patterns output from the sensor, determines a threshold value corresponding to each of a plurality of second color patterns having different colors;

a second image formation task that forms the plurality of second color patterns by controlling the plurality of image forming units;

a second measurement task that measures the plurality of second color patterns by controlling the sensor;

a detection task that detects an amount of color misregistration related to a relative position between a color pattern, among the plurality of second color patterns, that has a reference color and a color pattern, among the plurality of second color patterns, that has another color different from the reference color, on the basis of a result of the comparator comparing a second output value corresponding to a measurement result of the second color patterns output from the sensor with a threshold value corresponding to each of the second color patterns; and a correction task that corrects color misregistration between an image of the reference color and an image of the other color on the basis of the amount of color misregistration, wherein, in the second measurement task, the controller controls whether or not to set the threshold value to the threshold value corresponding to each of the plurality of second color patterns on the basis of the first output value output from the sensor in the first measurement task.

2. The image forming apparatus according to claim 1, wherein in the determination task, the controller determines a first threshold value corresponding to a color pattern of a first color among the plurality of second color patterns, and a second threshold value corresponding to a color pattern of a second color different from the first color among the plurality of second color patterns, on the basis of the first output value;

the color pattern of the first color is formed adjacent to the color pattern of the second color, on the downstream side of the color pattern of the second color in the predetermined direction; and in the second measurement task, the controller controls whether or not to change the threshold value corresponding to the color pattern of the second color among the plurality of second color patterns to the second threshold value on the basis of the first output value.

3. The image forming apparatus according to claim 1, wherein in the determination task, the controller determines a first threshold value corresponding to a color pattern of a first color among the plurality of second color patterns, and a second threshold value corresponding to a color pattern of a second color different from the first color among the plurality of second color patterns, on the basis of the first output value;

the color pattern of the first color is formed adjacent to the color pattern of the second color, on the downstream side of the color pattern of the second color in the predetermined direction; and in the second measurement task, the controller controls whether or not to change the threshold value corresponding to the color pattern of the second color among the plurality of second color patterns to the second threshold value on the basis of an output value corresponding to a measurement result of the color pattern of the first color, among the plurality of first color patterns, that has been output from the sensor, and an output value corresponding to a measurement result of the color pattern of the second color, among the plurality of first color patterns, that has been output from the sensor.

4. The image forming apparatus according to claim 1, wherein in the determination task, the controller determines a first threshold value corresponding to a color pattern of a first color among the plurality of second color patterns, and a second threshold value corresponding to a color pattern of a second color different from the first color among the plurality of second color patterns, on the basis of the first output value;

the color pattern of the first color is formed adjacent to the color pattern of the second color, on the downstream side of the color pattern of the second color in the predetermined direction; and in the case where a difference between an output value corresponding to a measurement result of the color pattern of the first color, among the plurality of first color patterns, that has been output from the sensor, and an output value corresponding to a measurement result of the color pattern of the second color, among the plurality of first color patterns, that has been output from the sensor, is less than a predetermined value, the controller changes the threshold value corresponding to the color pattern of the second color among the plurality of second color patterns to the second threshold value.

5. The image forming apparatus according to claim 1, wherein in the determination task, the controller determines a first threshold value corresponding to a color pattern of a first color among the plurality of second color patterns, and a second threshold value corresponding to a color pattern of a second color different from the first color among the plurality of second color patterns, on the basis of the first output value;

the color pattern of the first color is formed adjacent to the color pattern of the second color, on the downstream side of the color pattern of the second color in the predetermined direction;

in the case where a difference between an output value corresponding to a measurement result of the color pattern of the first color, among the plurality of first color patterns, that has been output from the sensor, and an output value corresponding to a measurement result of the color pattern of the second color, among the plurality of first color patterns, that has been output from the sensor, is greater than a predetermined value, the controller changes the threshold value corresponding to the color pattern of the second color among the plurality of second color patterns to another threshold value different from the second threshold value; and the other threshold value is a threshold value between the first threshold value and the second threshold value.

6. The image forming apparatus according to claim 1, wherein in the determination task, the controller determines a first threshold value corresponding to a color pattern of a first color among the plurality of second color patterns, and a second threshold value corresponding to a color pattern of a second color different from the first color among the plurality of second color patterns, on the basis of the first output value;

the color pattern of the first color is formed adjacent to the color pattern of the second color, on the downstream side of the color pattern of the second color in the predetermined direction; and in the case where a difference between an output value corresponding to a measurement result of the color pattern of the first color, among the plurality of first color patterns, that has been output from the sensor, and an output value corresponding to a measurement result of the color pattern of the second color, among the plurality of first color patterns, that has been output from the sensor, is greater than a predetermined value, the controller maintains the threshold value corresponding to the color pattern of the second color among the plurality of second color patterns at the first threshold value.

7. The image forming apparatus according to claim 1, wherein in the determination task, the controller determines a first threshold value corresponding to a color pattern of a first color among the plurality of second color patterns, a second threshold value corresponding to a color pattern of a second color among the plurality of second color patterns, and a third threshold value corresponding to a color pattern of a third color among the plurality of second color patterns, on the basis of the first output value;

the first color is different from the second color;

the second color is different from the third color;

the third color is different from the first color;

the color pattern of the first color is formed adjacent to the color pattern of the second color, on the downstream side of the color pattern of the second color in the predetermined direction;

the color pattern of the second color is formed adjacent to the color pattern of the third color, on the downstream side of the color pattern of the third color in the predetermined direction; and in the second measurement task, the controller controls whether or not to change the threshold value corresponding to the color pattern of the third color among the plurality of second color patterns to the third threshold value on the basis of the first output value.

8. The image forming apparatus according to claim 1, wherein in the determination task, the controller determines a first threshold value corresponding to a color pattern of a first color among the plurality of second color patterns, a second threshold value corresponding to a color pattern of a second color among the plurality of second color patterns, and a third threshold value corresponding to a color pattern of a third color among the plurality of second color patterns, on the basis of the first output value;

the first color is different from the second color;

the second color is different from the third color;

the third color is different from the first color;

the color pattern of the first color is formed adjacent to the color pattern of the second color, on the downstream side of the color pattern of the second color in the predetermined direction;

the color pattern of the second color is formed adjacent to the color pattern of the third color, on the downstream side of the color pattern of the third color in the predetermined direction; and in the case where a difference between an output value corresponding to a measurement result of the color pattern of the second color, among the plurality of first color patterns, that has been output from the sensor, and an output value corresponding to a measurement result of the color pattern of the third color, among the plurality of first color patterns, that has been output from the sensor, is greater than a predetermined value, the controller maintains the threshold value corresponding to the color pattern of the third color among the plurality of second color patterns at the first threshold value.

9. The image forming apparatus according to claim 1, wherein a distance, in the predetermined direction, between the color pattern of a first color included in the plurality of first color patterns and the color pattern of a second color included in the plurality of first color patterns is longer than a distance, in the predetermined direction, between the color pattern of the first color included in the plurality of second color patterns and the color pattern of the second color included in the plurality of second color patterns.

10. The image forming apparatus according to claim 2, wherein the first color corresponds to a reference color.

11. The image forming apparatus according to claim 2, wherein the first color corresponds to a chromatic color; and the second color corresponds to black.

12. The image forming apparatus according to claim 7, wherein the first color corresponds to a reference color.

13. The image forming apparatus according to claim 1, wherein the sensor includes a light-emitting element and a light-receiving element; and the light-receiving element receives regularly-reflected light from the color pattern.

* * * * *